United States Patent [19]

Brown

[11] 4,089,621

[45] May 16, 1978

[54] SELECTIVELY PRESSURIZED TANK FOR HYDRAULIC FLUID

[75] Inventor: Wilburn Kelly Brown, Morton Grove, Ill.

[73] Assignee: Pettibone Corporation, Chicago, Ill.

[21] Appl. No.: 715,412

[22] Filed: Aug. 18, 1976

Related U.S. Application Data

[63] Continuation-in-part of Ser. No. 525,850, Nov. 21, 1974, Pat. No. 3,976,124.

[51] Int. Cl.[2] ..... F04F 1/06

[52] U.S. Cl. ..... 417/118; 417/199 R; 417/313

[58] Field of Search ..... 417/86, 118, 287, 286, 417/199 R, 313; 137/211.5, 568; 60/39.48; 210/416 R, 416 AS, 416 DW, 416 F, 416 L, 416 M, 167; 415/110, 112, 116

[56] References Cited

U.S. PATENT DOCUMENTS

| | | | |
|---|---|---|---|
| 2,288,437 | 6/1942 | Conery et al. | 137/211.5 X |
| 2,362,586 | 11/1944 | Ruth | 137/211.5 |
| 2,935,078 | 5/1960 | Greenland et al. | 137/202 X |
| 3,091,929 | 6/1963 | Hipp | 417/287 X |
| 3,278,030 | 10/1966 | Rosaen | 417/86 X |

*Primary Examiner*—Carlton R. Croyle
*Assistant Examiner*—Donald S. Holland
*Attorney, Agent, or Firm*—Louis Robertson

[57] ABSTRACT

A tank for oil or other hydraulic fluid is kept under a few pounds of air pressure during operation to keep air from being drawn into the fluid and to aid its flow to the pump. The pressure is provided dependably and quickly by a small air pump driven whenever the hydraulic pump is driven. A bleed-off discharge causes prompt dissipation of the pressure on shutdown so as not to cause oil leakage while the associated hydraulic pump is idle. The hydraulic level is below the pump shaft level so there will be no leakage by gravity.

3 Claims, 4 Drawing Figures

SELECTIVELY PRESSURIZED TANK FOR HYDRAULIC FLUID

CROSS-REFERENCE TO RELATED APPLICATION

This application is a continuation in part of application Ser. No. 525,850 filed Nov. 21, 1974, issuing Aug. 24, 1976 as U.S. Pat. No. 3,976,124, and serves as a division.

BACKGROUND OF THE INVENTION

The invention of which the present disclosure is offered for public dissemination in the event adequate patent protection is available relates to hydraulic reservoirs or storage tanks from which the hydraulic pump of a heavy-duty hydraulic-power equipment draws hydraulic fluid which is to be pumped at high pressure to operate the equipment.

Modern usage of hydraulic circuits require special fluids for continued high performance, because of high speed and high pressures. This means that normal automobile type oils will not do the job. Automatic transmission fluids or its equivalent is required, even though the term "oil" is commonly used for them. This hydraulic fluid is not only very expensive, but hard to get in quantity, in out-of-the-way places. Hence, avoiding the loss of hydraulic fluid can be very important.

One limiting factor in all hydraulic circuits is the ability of the pump to get the fluid through the suction line so as to be able to pump it under high pressure to the point of work. The temperature and the viscosity and length and size and friction of the line are the deciding factors.

In order to help keep the pump charged, there has for many years been a well-known preference to place the hydraulic tank above the pump, or even to raise the hydraulic tank to the highest elevation that can reasonably be used. This gravity-aided feed, however, has a great disadvantage in that this head is always on the pump, and can, especially during an overnight stand, drain the tank when the pump's shaft seal leaks from wear or fatigue. The loss of oil is not always readily apparent, as the machine may be parked in a sandy area; and before it becomes apparent, the pump may cavitate, and destroy itself because of starvation or lack of oil. Another disadvantage of overhead oil tanks is that it is extremely difficult to change the seals of the pump, or even the pump itself. It is not permissible to provide a shut-off valve because of the danger of leaving it closed. Such a large vessel would be required to recover the oil that drains out of such a reservoir that recovery is rarely practical. Normal reservoirs contain a minute's supply of oil, so when this is 60 to 100 or more gallons of oil, handling it during repair becomes a major problem. It is not easy to store and keep clean such a large vessel, even in a well-equipped repair shop.

Loss of the hydraulic fluid from a tank can be a very serious problem except in the rare instances that a new supply is at hand. With nearly all machines, the engine direct-drives the pumps, with no drive-disconnect, so that the operator cannot even run the engines to get the machine to a repair shop without damaging the pumps because of not having them full of oil all the time.

Because of these problems with a raised tank, an alternative for many years has been to locate the oil tank below the level of the pump, but provide pressure in the tank to give extra help in getting the fluid to the pump. The common way to provide the pressure has been by having the tank generate pressure within itself. This is accomplished by having a combination relief valve and check valve in the top of the tank so that level changes in the tank due to movement of the motor pistons causes the tank to trap the difference of the volume of air caused by this movement.

Unused energy or friction of moving parts causes the trapped air to build up pressure more quickly by heating the air. Such pressure systems have also been used with elevated tanks, but even that did nothing toward removing the danger of loss of the fluid by an overnight leak. However, even with tanks lower than pumps, this system is not safe.

The danger, then, is that because there is a pressure head at the pump, the same as with the overhead tank, loss of the fluid may result. Even the part of the pressure due to heating the air in the tank may long remain. Oil that is not moving, as when the machinery is shut down, loses its heat very slowly.

The present invention removes the disadvantages of both systems by generating the necessary pressure, to help move the oil to the pump, only when the system is operating; by quickly removing the pressure when it is shut down; and by having the tank below the pump so there is no gravity head at any time.

The invention also has the advantage, over pressure developed by trapping and heating the air in a tank, that the pressure is provided more quickly and minimizes the drawing of air into the fluid when the shaft seal of the pump is imperfect. There has long been recognition that with unpressured equipment, a failing shaft seal will cause air to be drawn in at the hydraulic pump. Air in the oil is quite objectionable, and there have been efforts through the years to avoid or minimize its being drawn in. So far as known, all such efforts in the past have failed to achieve the aim dependably, or have had objectionable side effects.

SUMMARY OF THE INVENTION

According to the present invention, a very small air pump is provided with its drive direct-connected so as to be driven whenever the hydraulic pump is driven. Its output flows into the storage tank above the oil to supply air pressure tending to force the oil to the hydraulic pump. This air pressure is preferably high enough to provide a slight positive oil pressure in the intake chamber of the hydraulic pump when the hydraulic pump is normally operating. The drive shaft of the hydraulic pump runs through a wall pump in or open to this chamber, and hence a positive pressure in this chamber precludes the drawing in of air along this shaft, even if the shaft seal is not in perfect condition. According to a preferred form of the present invention, a tiny bleed opening quickly dissipates the air pressure on shutdown, so that there is substantially no leakage after shutdown.

The advantages and objects of the invention may be more apparent from the following description and from the drawings.

DESIGNATION OF FIGURES

DESCRIPTION OF THE PREFERRED EMBODIMENT

Figure 1:
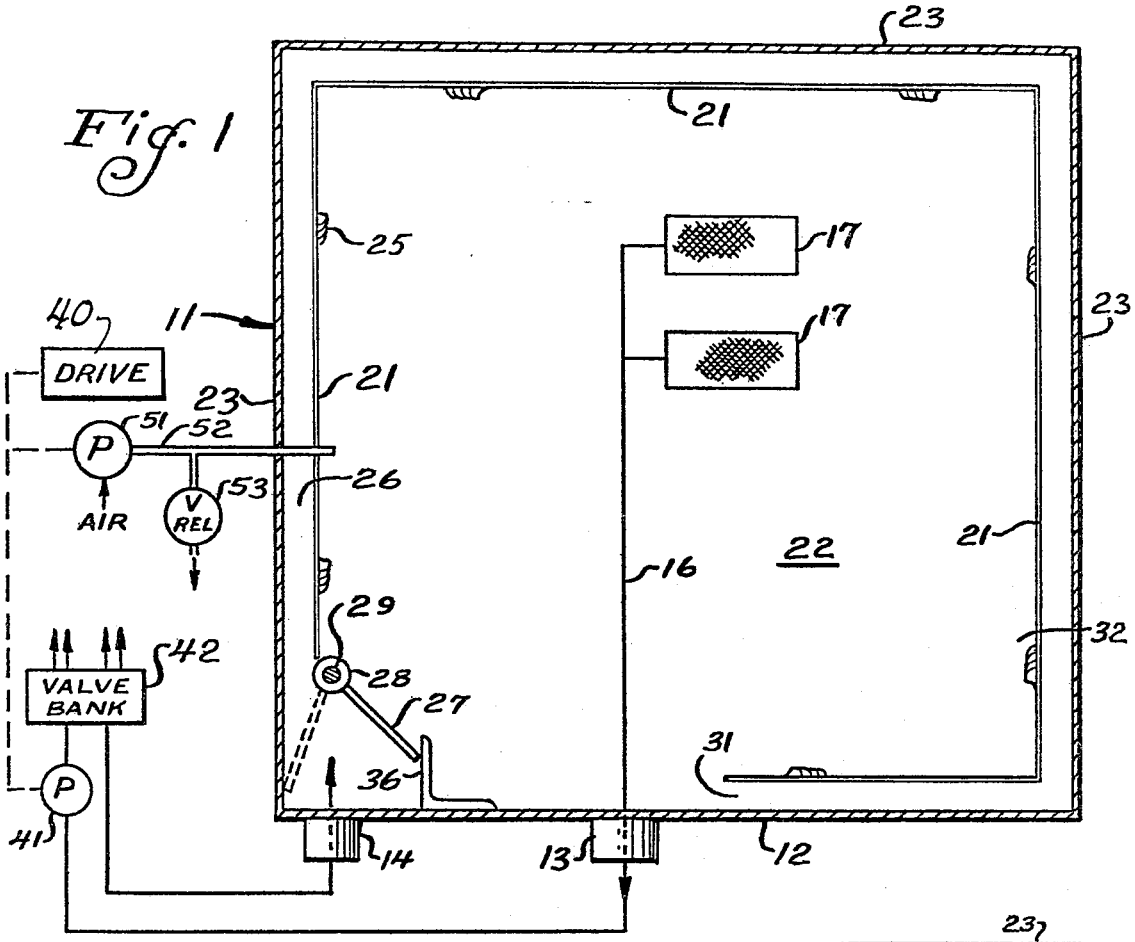
FIG. 1 is a downwardly looking cross-sectional view of one form of the tank chosen for illustration, with connections shown diagrammatically.
Figure 2:
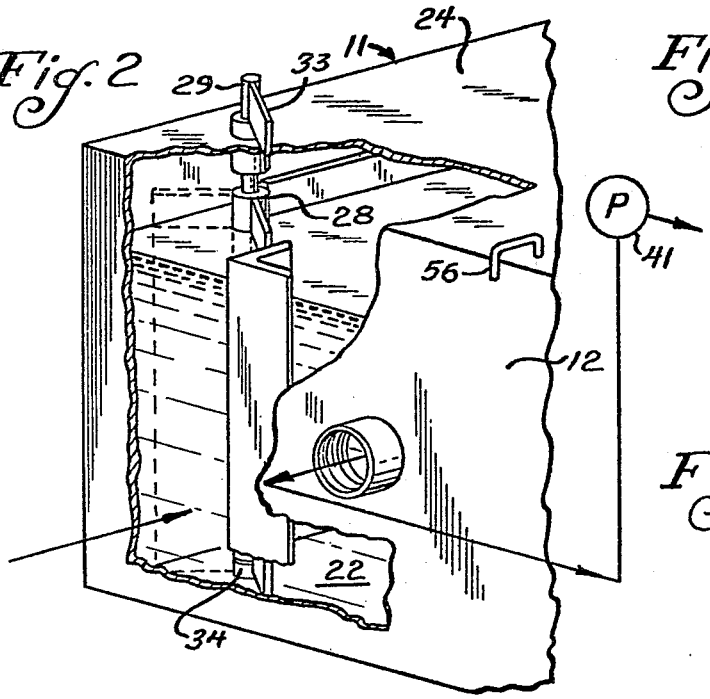
FIG. 2 is a partial perspective view of the tank showing its bleed vent, and partly broken away to show the parent-patent flap valve.

Although the following disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

In some respects the tank 11 is conventional. Thus its outer structure is entirely of steel and it may have four vertical walls, a bottom wall and a top wall 24. One vertical wall 12 is provided with an outflow fitting 13 and a return or inflow fitting 14. As indicated by diagrammatic line 16, the outflow fitting 13 is connected with filter means 17 through which oil is conventionally drawn from a little above the bottom of the tank. The top wall 24 of the tank is preferably permanently secured, as by welding. Access openings may be provided to permit periodic cleaning out of the metal particles which gather on the floor of the tank and the screens, such openings having pressure-proof closures.

COOLING AND SETTLING PASSAGE OF PARENT INVENTION

According to the parent-patent invention, a curtain 21 rests on the tank bottom 22 and extends nearly all of the way around the periphery of the tank 11, being spaced only a short distance from the side walls 12 and 23. Although this curtain 21 should be secured to the bottom 22 (as by tack welding 25) and should extend above the expected maximum liquid level in the tank, it need not have a leak-proof seal to the bottom surface and need not extend to the top wall 24. When desired, oil which is returned to the tank 11 from conventional control valve 42 (which is conventionally a manually operated valve for controlling associated apparatus) is directed to flow through the cooling and settling channel 26 between wall 21 and walls 23 and 12 by a flap valve 27 extending from one side of a hub tube 28 mounted on a shaft 29, to which it is firmly secured or keyed. After traversing the entire peripheral length of the cooling channel 26, to the discharge end 31 thereof, the oil flows into the main storage space 32 comprising the entire tank volume inside of the curtain 21.

Figure 3:
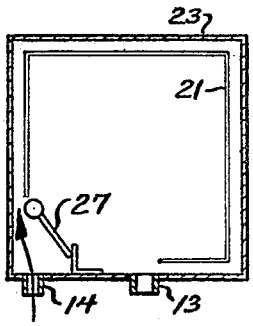
FIGS. 3 and 4 are flow diagrams to show the flow respectively for cooling of the oil and for heating it.
Figure 4:
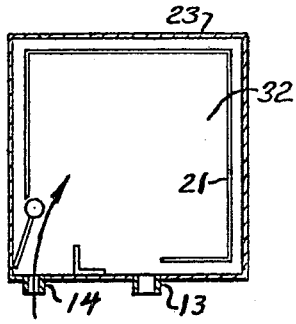

In cold weather, when the oil needs to be heated by circulating it before starting hydraulic operations, the flap valve 27 is turned from the position shown in FIG. 3 to the position shown in FIG. 4, which is also the dotted line position of FIG. 1. This swinging of the valve is accomplished by a handle 33 secured on shaft 29 which extends to the top wall 24 of the tank. The shaft 29 also extends into a collar 34 welded to the bottom 22 of the tank. With this position of the flap valve 27, oil can flow directly into main storage chamber 32, as seen in FIG. 4.

It is not necessary that the flap valve 27 seal tightly. In the cooling position it rests against a vertical jamb 36, which may be one angle of an angle bar welded to wall 12. In its other position it rests against the wall 23.

Other cooling details and the cooling operation are described in the parent patent and need not be repeated here. An improvement which may now be preferred, however, is to be able to set the handle 33 for any desired apportioning of flow between the two entry routes, so that after the oil heats, a setting may be chosen that will keep the temperature within an optimum range.

OIL PRESSURIZATION WITHOUT LEAKAGE

The inventive feature to which the claims of the present application are directed relates to a problem which arises when the drive shaft of hydraulic pump 41 is at least as high as the oil level in tank 11. Although such a high location is desired, so that oil from the tank cannot leak by gravity through a defective seal of the pump drive shaft, it gives rise to the problem that the suction of pump 41 then tends to draw air into the system through the faulty seal.

According to the present invention, the drawing of air into the oil is considerably reduced or virtually eliminated by pressurizing oil in the tank. Thus air pump 51 pumps air into airline 52 which discharges above the oil in tank 11. A relief valve 53 limits this air pressure to a desired value, such as 5 PSI. The pressure should be enough so that a positive pressure will be maintained at the intake or shaft chamber of oil pump 41 to prevent air from being drawn into the oil at this point, as is especially likely to occur as the shaft seal becomes worn.

Oil in such tanks has been pressurized before, but the past pressurizing by using a sealed tank and relying on a temperature increase for pressurizing has defects. One defect is that the pressure increase is slow to develop. It is nonexistent when most needed because the oil is cold and more viscous. Later it may be inadequate. Another defect is that the pressure remains after the operation has ceased and may cause oil leakage. Gravity pressurization by having the tank above the level of the oil pump is even worse as to oil leakage. Leakage may then continue throughout a night or weekend — or until the oil has all leaked out.

These faults are here overcome. By pressurizing with air pump 51 driven when the oil pump 41 is driven (by the same drive means 40) the pressure is applied promptly upon start-up and ceases to be applied upon shutdown. Alternatively, air pump 51 can be normally coupled to the engine which drives pump 41, even though the drive for pump 41 may be independently decoupled. In other words, the pump is in open communication with and supplying pressure to the tank under normal initial operating conditions, i.e. before any special operating conditions such as cavitation occur. A bleed-vent 56 is provided (unless air leakage is dependable) to dissipate the pressure soon after the pump 51 stops. Tank 11 preferably has its maximum oil level below the level of pump 41, or its drive shaft, so that no oil will leak at this point by gravity.

If the pump 51 is driven when pump 41 is not, and especially if it may be driven in long idle periods, means to discharge the air freely may be provided, so as not to maintain pressurization in tank 11. In that event, an interlock to ensure closing the discharge when pump 41 is driven would be desirable. If valve 53 has an adjustment knob (as some users may prefer) and can be set low enough to avoid a positive pressure at the drive shaft of pump 41, that may be done. Ideal operation would be to pressurize tank 11 just before starting pump 41, to a pressure higher than normal, to force the viscous cold oil to the pump 41, and lower the setting of valve 53 when the oil has warmed, to be just enough to maintain zero pressure at the shaft seal during operation. Some operators may prefer to have valve 53 invariable (except for factory or internal adjustment) and pump 51 invariably driven with pump 41 for simplicity and so that lack of attention can not cause serious consequences.

If an adjustment knob for valve 53 is provided, a pressure-vacuum gauge could be connected adjacent the intake port of pump 41 and the knob could be turned to the point that makes the gauge read zero. The zero setting of the gauge could be "off" enough to compensate for flow-friction loss into the pump, if found desirable. Valve 53 and the gauge could both be located in the cab. Making a valve such as 53 responsive to the pressure at the intake to pump 41 is another possibility. It would then always supply just enough air to tank 11 to yield zero pressure (i.e., the pressure of the atmosphere, at the pump intake or shaft).

Pump 51 should have a capacity only slightly larger than the expected flow through vent 56 at 5 lbs., so that the discharge of excess air through relief valve 53 will never be objectionable. Indeed, careful correlation or an adjustment on vent 56 might be found to make relief valve 53 unnecessary.

ACHIEVEMENT

On start-up, tank 11 is quickly pressurized so that hydraulic pump 41 will not draw in air, even with a leaky shaft seal; and so that the shaft seal of pump 41 is not subjected to such high pressure differentials as to greatly shorten its life. On shutdown, the pressurization will be quickly dissipated so that no pool of oil will be found under pump 41 at the next start-up time. Because pump 41 never draws in air (or virtually never), the oil has the dependable noncompressible characteristics of air-free oil that are desired.

The invention can be added to hydraulic systems already in operation quite easily, at least where the hydraulic pump has no disconnect in its drive by the engine. Here the added air pump may be battery driven, through the ignition or other engine-shut-off switch, so that the air pump will be stopped when the engine is turned off. This engine-coupled electric drive has an advantage that if the ignition switch is turned "on" a few seconds before the engine is started, the tank will be already pressurized when the hydraulic pump starts operating.

I claim:

1. A hydraulic system including a hydraulic pump, a tank for hydraulic fluid, an inflow connection leading into the tank and an outflow connection leading from the tank to the hydraulic pump; an air pump connected in open communication with the tank upon normal initial operation of the hydraulic pump, and effective whenever the hydraulic pump is driven for supplying pressurization above the fluid in the tank to supply the fluid to the hydraulic pump under pressure and minimize the sucking in of air at the hydraulic pump; drive means for driving said air pump whenever the hydraulic pump is driven and not thereafter; and means for promptly and completely dissipating air pressure in the tank when the air pump is not driven; the drive shaft of the hydraulic pump being at least as high as the hydraulic fluid in the tank.

2. A hydraulic system including a hydraulic pump, a tank for hydraulic fluid, an inflow connection leading into the tank and an outflow connection leading from the tank to the hydraulic pump; and an air pump connected in open communication with the tank upon normal initial operation of the hydraulic pump, and effective whenever the hydraulic pump is driven for supplying pressurization above the fluid in the tank to supply the fluid to the hydraulic pump under pressure and minimize the sucking in of air at the hydraulic pump; the drive shaft of the hydraulic pump being at least as high as the hydraulic fluid in the tank; and said system including means for limiting the air pressure in the tank to a value low enough to avoid a substantial positive pressure of hydraulic pump entering the hydraulic pump.

3. A hydraulic system including a hydraulic pump, a tank for hydraulic fluid, an inflow connection leading into the tank and an outflow connection leading from the tank to the hydraulic pump; and air pump connected in open communication with the tank upon normal initial operation of the hydraulic pump, and for supplying pressurization above the fluid in the tank to supply the fluid to the hydraulic pump under a pressure state that minimizes the sucking in of air at the hydraulic pump; drive means for driving said air pump whenever the hydraulic pump is driven and not thereafter; and means for promptly and completely dissipating air pressure in the tank when the air pump is not driv;en; the drive shaft of the hydraulic pump being at least as high as the hydraulic fluid in the tank; and said system including means for limiting the air pressure in the tank to a value low enough to avoid a substantial positive pressure of hydraulic fluid entering the hydraulic pump.

* * * * *

UNITED STATES PATENT AND TRADEMARK OFFICE

CERTIFICATE OF CORRECTION

PATENT NO. : 4,089,621

DATED : May 16, 1978

INVENTOR(S) : Wilburn Kelly Brown

It is certified that error appears in the above-identified patent and that said Letters Patent are hereby corrected as shown below:

In column 6, line 32 (next to last line of claim 2) before the word "entering", change "pump" to -- fluid --.

In column 6, line 37, before "air pump" change "and" to -- an --.

In column 6, line 1, change "I claim" to a heading:

-- CLAIMS (AREAS OF PROTECTION) --

Signed and Sealed this

*Eighth* Day of *May 1979*

[SEAL]

*Attest:*

RUTH C. MASON
*Attesting Officer*

DONALD W. BANNER
*Commissioner of Patents and Trademarks*